United States Patent [19]

Dannemann

[11] Patent Number: 4,955,170

[45] Date of Patent: Sep. 11, 1990

[54] STRUCTURES FOR ROOFS MADE OF TILES OR THE LIKE

[76] Inventor: Roberto G. C. Dannemann, Alsina 971 1°, "10"-Capital Federal, Argentina

[21] Appl. No.: 376,568

[22] Filed: Jul. 7, 1989

Related U.S. Application Data

[63] Continuation-in-part of Ser. No. 181,317, Apr. 13, 1988.

[30] Foreign Application Priority Data

Apr. 29, 1987 [AR] Argentina ..... 307426

[51] Int. Cl.[5] ..... E04D 1/34

[52] U.S. Cl. ..... 52/547; 52/478; 52/536; 52/542

[58] Field of Search ..... 52/536, 547, 478, 551, 52/302, 550, 539, 542

[56] References Cited

U.S. PATENT DOCUMENTS 2,659,323 11/1953 Alvarez, Jr. ..... 52/302
4,731,969 3/1988 Baker et al. ..... 52/536

FOREIGN PATENT DOCUMENTS 182316 3/1907 Fed. Rep. of Germany ..... 52/547
160906 3/1921 United Kingdom ..... 52/547

*Primary Examiner*—Carl D. Friedman
*Assistant Examiner*—Lan Mai
*Attorney, Agent, or Firm*—Wells & White

[57] ABSTRACT

Structures for roofs, made of tiles of substantially planar and rectangular configuration or the like, including on one of their smaller edges at least one flange parallel to this edge which prevents displacement of the tiles with respect to the elongated supports on which the tiles rest directly by means of the flanges. A plurality of the supports are distributed one per each horizontal tile row and parallel therebetween, resting on a second plurality of more resistant elongated members. The elongated members are generally spaced from each other a distance larger than the space between the supports, horizontal and parallel as per inclined planes in the direction of the roof slope. Each elongated support has an "L" cross section from the edges of which longitudinal flanges project, forming angles of no less than 90° with their respective legs. The legs leave therebetween faced free ends of the flanges a space allowing the direct oblique introduction of each tile by its flanged edge, until each tile is placed on the slope direction, corresponding to the resting point of the opposed edge on the elongated support which supports the subsequent lower and horizontal tile row.

8 Claims, 3 Drawing Sheets

FIG. 3(a)
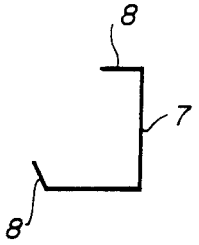
FIG. 3(b)
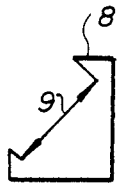
FIG. 3(c)
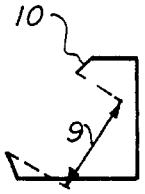
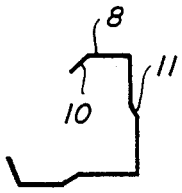
FIG. 3(d)
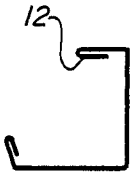
FIG. 3(e)
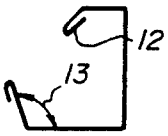
FIG. 3(f)
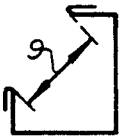
FIG. 3(g)
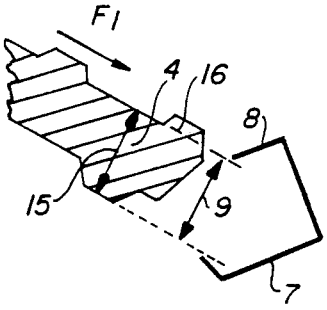
FIG. 4(a)
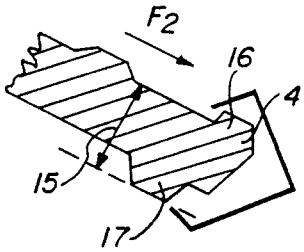
FIG. 4(b)
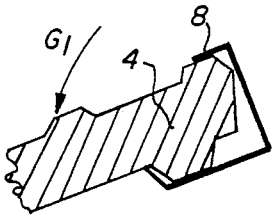
FIG. 4(c)

STRUCTURES FOR ROOFS MADE OF TILES OR THE LIKE

CROSS REFERENCES TO RELATED APPLICATIONS

This is a continuation-in-part of application Ser. No. 07/181,317 filed Apr. 13,1988.

BACKGROUND OF THE INVENTION

The present invention relates to a structure for supporting a roof made of French type tiles or the like, such as Marseille type tiles, Holland type tiles, etc. normally made of ceramics or of any other suitable material These tiles are low porosity, rectangular rigid pieces, shaped with outstanding ribs, longitudinal or parallel to the larger sides. These ribs mate with the two traverse smaller sides or edges which have grooves or engagement portions and emerging teeth varying in accordance with the tile type, but always for engaging each tile with adjacent ones. The tiles of each row are placed with their lower smaller edges on the upper edges of the next lower tile row.

In practice, these tiles may have at least a through hole close to their upper edge for connecting these tiles on a wooden purlin forming part of the structure supporting the tiles, by means of nails or wire fasteners. Emerging from the bottom of the same upper smaller edge there exist normally two teeth or a rib which rest laterally on the purlins to avoid the downward slip of the tiles.

This structure is conventionally comprised by two main portions: the supporting structure per se, comprising trusses, rafters, beams, etc. and, secondly, by a direct supporting and fastening device, commonly comprised of horizontal purlins or strips, placed as per parallel lines, supported by the above mentioned rafters or the like, and having a traverse slope resulting from the slope of the rafters.

The above mentioned parallel purlins or strips are engaged to rafters through nails or screws, and the space therebetween is somewhat smaller than the length of the tile, so as to allow each tile to be supported by mating simultaneously with each traverse smaller edge, on corresponding purlins. Therefore, the upper edge of the next lower row of tiles rests on each purlin, and the lower edge of the next upper row rests on the same edge.

Consequently, as is conventional, margin portions of the upper traverse edges of the tiles in each row are engaged by nails or wire laces; and supported laterally by the teeth or a rib on the bottom of the tile in turn, the margin portions of the lower edges of the tiles on the next upper row rest and fit, due to their weight, on these portions. Nevertheless, there are some cases in which fastening means are not used and tiles are simply superimposed and only held in place by the teeth, thus resulting in several disadvantages.

Generally, the above mentioned structures, such as trusses, rafters, purlins, etc. are made of wood. Such wood may slip or move due to load action or due to the fact that it is green, which causes scratches and/or breakage of the tiles, or any other undesired abnormality.

Among the mentioned engaging and supporting resources, the following are the two preferred alternatives, namely: (a) sizing the purlins supported by rafters, and separating the rafters so as to assure sufficient supporting strength against torsion and bending in order to avoid tile displacement or, at least, to assure that tile displacement does not affect the stability thereof. This stands for an oversizing of values resulting from the use of conventional calculated strains according to different types of wood; and (b) placing a continuous planking, preferably a tongue and groove planking, between the rafters or the like, under the above mentioned purlins, thus strengthening the structure against movement of the purlins.

When employing alternative (b), often a layer of waterproof material is added, preferably an asphalt impregnated felt, which is applied perfectly flat on the planking, in order to form a barrier against water which may have passed through tiles or cracks thereof.

This waterproof coating is less suitable when tiles are directly engaged on the supporting and engaging purlins, transversely to rafters, such as in alternative (a); but in such cases aesthetics of the roof are affected, unless it is covered by some means such as paint, etc.

In order to avoid tile displacement, it is known in the art to use structural members, including supporting purlins, made of metal, on which tiles rest. In such a case, wire fastening or nailing to prevent relative displacement between tiles and purlins is unavoidable. Due to the fact that all tiles should be wire fastened or nailed, operators' movements may result in further cracks or breakage. Besides, this operation involves delays and increases in man hours, and therefore the cost is notably increased.

SUMMARY OF THE INVENTION

The present invention solves the above disadvantages of the prior art since it reduces man labor, minimizes structure displacements and prevents tile breakage.

Therefore, the instant invention provides a structure wherein purlins on which French tiles or the like are supported and fixed where the purlins are elongated solid members, having a 90° cross section profile, or "L" profile, of substantially equal legs, as per the roof slope. The edges of these legs are projected forming respective flanges constituting with these legs an angle of at least 90°, and allow between corresponding free edges a space slightly larger than the smaller thickness of the upper small edges of the tiles.

The introduction of the upper small edge of the tiles into the purlins is only possible by positioning the edge of the tiles, one by one, in the opening of the purlin in such a way that the emerging rib adjacent to the upper small edge of the tiles becomes tightly lodged under the upper outstanding flange of the purlin, and then rotating the tile downwards, forcing the crest of the teeth located on the bottom of the tiles, near to the same upper smaller edge of the tile, to pass the lower flange of the purlin. The particular unique geometric relations between the purlin and the dimension and configuration of the upper small edge of any particular tile constitutes the novelty of this invention, allowing the engagement of the upper smaller edge of the tile in the cavity of the purlin. In this way each tile becomes automatically fixed in any direction except for upward rotation, which allows taking out the tiles again one by one when it is necessary in the future, for replacement or other causes. The retirement of tiles is accomplished n turning up tile by tile up to a position where the opening between edges of the purlin equals the minor thickness f the tile near the upper edge, allowing removal of the tile. Consequently, the placing and eventual retirement of tiles will be a fast and straightforward operation with no need for special fastening devices like nails, screws or the like and avoiding the deterioration which often occurs when a tile roof is dismantled.

As disclosed above, the upper smaller edges of each tile are lodged into the inner part of the profile, and this is the basic difference between the structure of the present invention and prior art metal purlins.

The novel structure of the present invention is a functional combination of known members, whether individually or in the same or different number, in which the novelty resides int eh particular shape of one of the members constituting the structure, which structure is known per se. Due to the instant functional improvement various advantages are obtained in the whole structure, such as elimination of the auxiliary elements used in the prior art, as well as improvements in man labor, economy and life of the structure.

BRIEF DESCRIPTION OF THE DRAWINGS

In order to facilitate an understanding of the abovementioned advantages of the present invention, to which users and those skilled in the art may add modifications and/or other improvements, and to describe in detail the constructive, constitutive and functional features of the structure of the invention, preferred embodiments will be disclosed hereinbelow, which are schematically shown without a determined scale in the attached drawings. It is to be noted that the following disclosure, taken along with the appended drawings, is an exemplary description of the present invention, not intended to limit or condition the scope thereof.

FIGS. 3(*a*), 3(*b*), 3(*c*), 3(*e*), and 3(*g*) are schematic views including seven alternative embodiments of the invention showing the purlin profiles of the present invention;

FIGS. 4(*a*), 4(*b*) and 4(*c*) show three schematic sections corresponding to respective steps for positioning French tiles using the structure of the present invention;

In all the figures, the same reference numerals designate the same or equivalent parts constituting the examples on which the following disclosure is based.

DETAILED DESCRIPTION OF THE INVENTION

Figure 1:
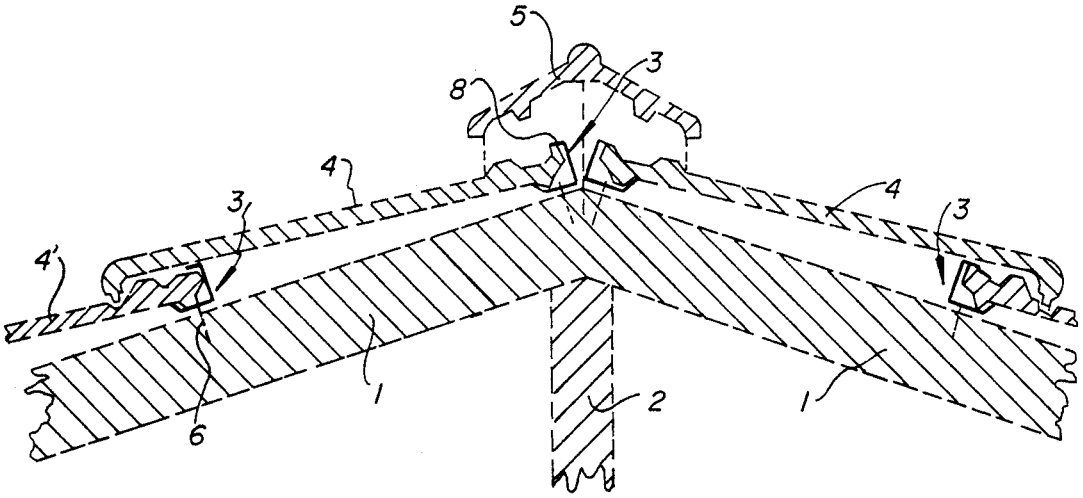
FIG. 1 is a cross section of a roof portion with French tiles, including a structure in accordance with the present invention.

The structure shown in FIG. 1 comprises a truss with upper beads 1, posts 2 and purlins 3 on which a plurality of French tiles 4 is supported, and on which special ridge tiles 5 may also be included.

Conventionally, the purlins 3 are made of wooden strips which are nailed or screwed onto upper beads 1, which, very often, are replaced by resistant sloping rafters or beams, instead of using trusses, posts and auxiliary members.

The instant invention may be used in any case, whether trusses or rafters are used, since the novelty resides in that, in the disclosed combination of structural members, purlins 3 are elongated profiled parts which are preferably made of folded steel sheet.

These parts are engaged to the rafters or the like by means of nails or screws 6, and are shaped such that the cross section of these profiles is preferably a straight angle or "L" section, the legs of which 7 may or may not have the same size, as seen in FIG. 3, extending as per respective folds forming flanges 8 directed towards the interior of the cavity of the angle. Therefore, the disclosed profile is comprised by main legs 7, flanges 8 and a space the opening of which, 9, is clearly seen in FIG. 3. Alternative embodiments of the profile of the invention are the inclusion of second flanges 10, longitudinal folds 11, and plains or bends 12, as well as angles 13 greater than 90° or any other suitable angle.

Figure 2:
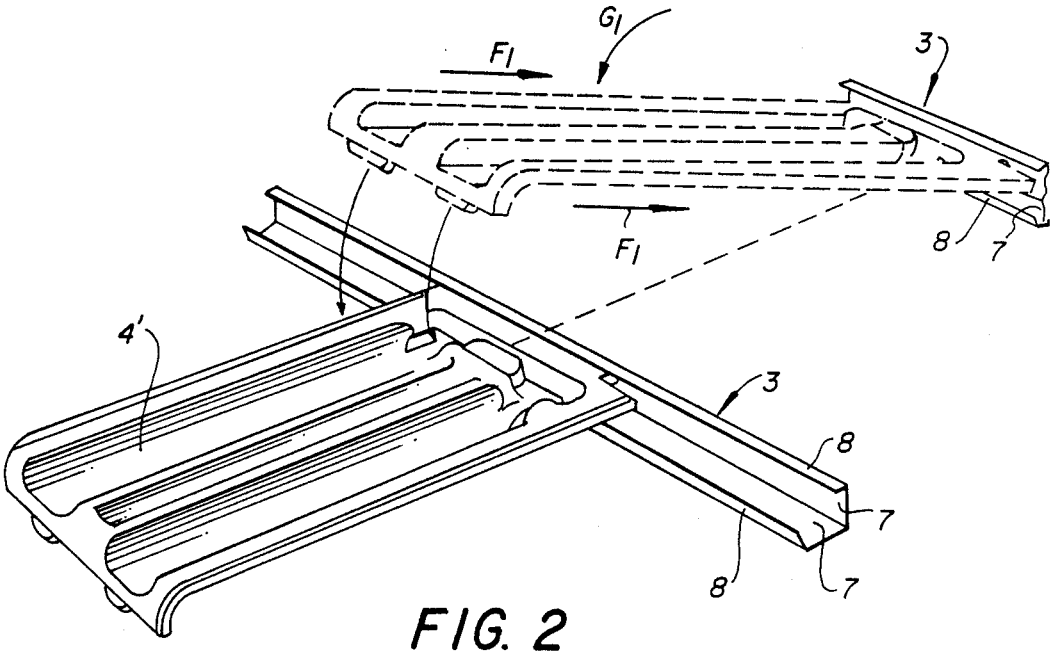
FIG. 2 is a perspective view of a single tile, showing the step prior to its final positioning.

FIG. 2 shows that each tile is placed, using the abovementioned purlins 3, without any need of nails or wire laces, since the upper flanges 8 of the purlins operate as fixing means for the tiles 4 after their introduction into the upward cavity 8 in the purlins.

Figure 5:
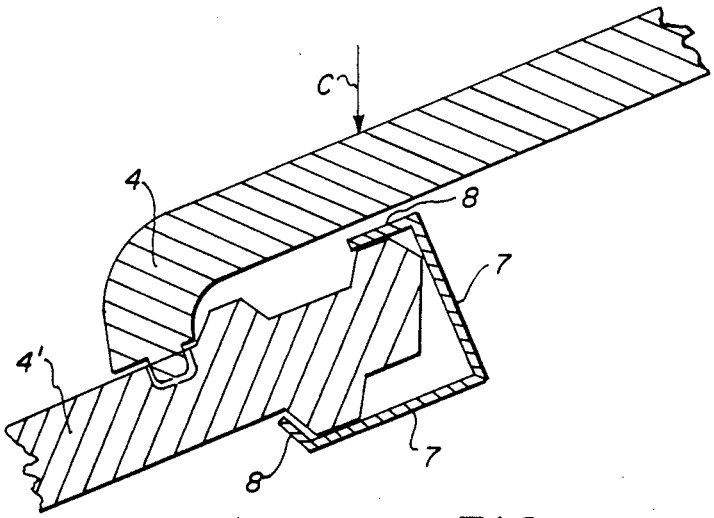
FIG. 5 is a partial view in which two subsequent tile rows are supported on a common member, in accordance with the present invention.

Therefore, each tile is introduced along arrows "$F_1$" passing through opening 9 of the purlin and then is turned as per arrows "$G_1$" until it is freely supported on the next lower tile 4. The dimensions of the invention, determined by the relationship between the thickness 15 of the tile in the region and the width of the space or opening 9, permit that each tile be introduced only with an inclination contrary to the slope of the roof, FIGS. 4–6; while, when turned to its final position, the tile cannot be withdrawn since each flange 8 acts as holding means.

The schematic sections shown in FIGS. 4(*a*), 4(*b*) and 4(*c*) illustrate the installation of tiles on purlins 3 for correct support and fastening.

The tiles have an emerging rib 16 on the upper narrow edge while having on the opposite lower face teeth 17 acting as another rib, these ribs defining a structure which allows penetration of the opening 9.

Once the upper edge of the tile has been introduced into opening 9 the tile is rotated in the direction of arrow G, as shown in FIG. 2.

Figure 6:
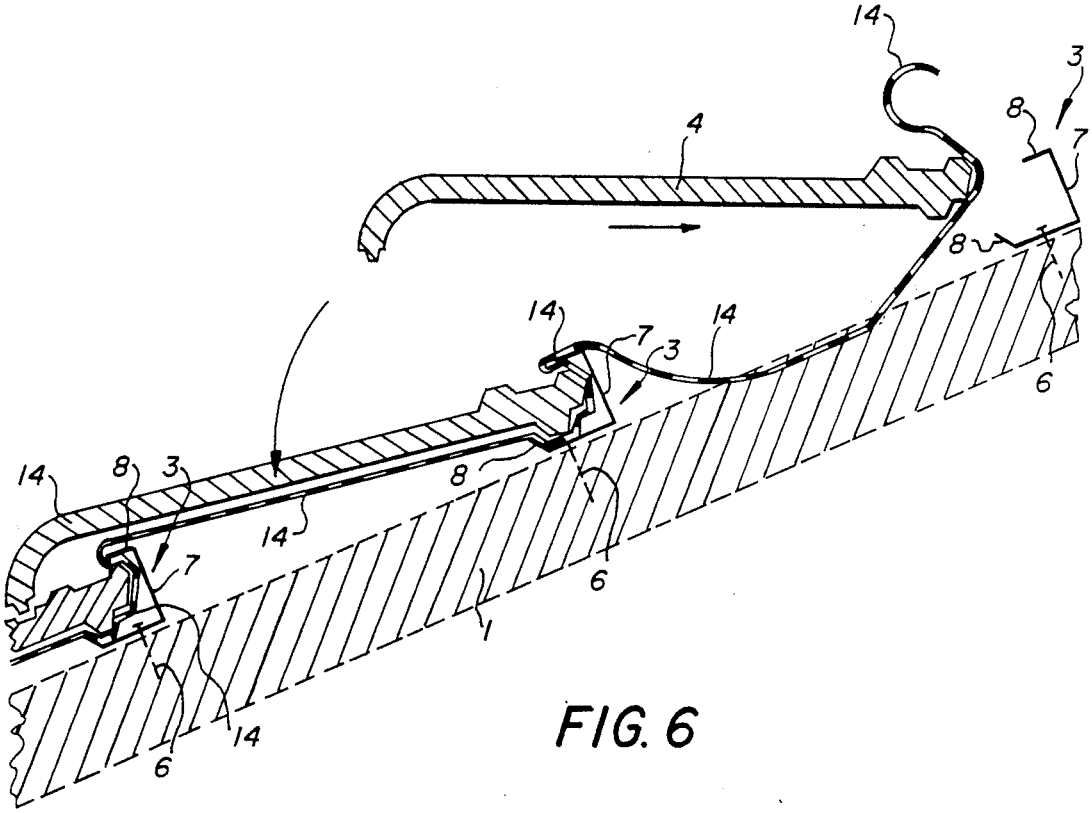
FIG. 6 is a cross section in which sheet waterproof elements are included, taking advantage of the present invention.

Thus, whether waterproof "rubber oil" sheets or the like are placed below purlins 3, or tiles are left with their lower faces bar, the invention includes the possibility of placing and fixing, simultaneously with the tiles, a waterproof and resistant flexible sheet 14, as shown in FIG. 6. This sheet may be made of any of known aesthetic plastics which prevent in this way the use of artificial ceiling or other finishing means.

When carrying out the invention many modifications and/or improvements may be introduced, all of which are to be considered as alternative embodiments of the instant invention, which is only limited by the spirit and scope of the appended claims.

I claim:

1. A roof structure, comprising:

a plurality of L-shaped purlins positioned longitudinally across the slope of a roof, said purlins having first and second legs forming said L-shape, each of said first and second legs including a respective first and second depending flange portion on a free end thereof, said first and second respective depending flange portions of each of said first and second legs defining a space therebetween; and, a plurality of tiles each having a first and second face and an upper edge and an emerging rib located along each upper edge of each tile on said first face thereof, and a protruding tooth located on said second face of said tile, also along said upper edge thereof; wherein, said upper edge of said tile is inserted in said space defined by said first and second depending flange portioned, and said emerging rib and protruding tooth engage said first and second depending flanges respectively, and thereby restrict removal of said tile from said L-shaped purlin.

2. The roof structure of claim 1, wherein:

said defined space is approximately equal in dimension to the thickness of one of said tiles when said thickness is measured from said first face to a crest of said protruding tooth located on said second face.

3. The roof structure of claim 1, wherein: said L-shaped purlins are formed of folded sheet metal.

4. The roof structure of claim 3, wherein: said sheet metal comprises sheet steel.

5. The roof structure of claim 1, wherein: said L-shaped purlins are formed of extruded metal.

6. The roof structure of claim 5, wherein: said extruded metal is steel.

7. The roof structure of claim 1, wherein: said L-shaped purlins are formed from high density synthetic material.

8. The roof structure of claim 1, further comprising:

a flexible sheet placed between the L-shaped purlins and said tiles, for enhancing the resistance of the roof structure to penetration by water.

* * * * *